US006840694B2

(12) United States Patent
Gueret

(10) Patent No.: US 6,840,694 B2
(45) Date of Patent: Jan. 11, 2005

(54) APPLICATOR ASSEMBLY, SYSTEM AND METHOD

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 34 days.

(21) Appl. No.: 10/073,302

(22) Filed: Feb. 13, 2002

(65) Prior Publication Data

US 2002/0127046 A1 Sep. 12, 2002

(30) Foreign Application Priority Data

Feb. 13, 2001 (FR) ..... 01 01932

(51) Int. Cl.[7] ..... B05C 11/00
(52) U.S. Cl. ..... 401/266; 401/119
(58) Field of Search ..... 401/119, 126, 401/127, 201, 261, 265, 266, 130

(56) References Cited

U.S. PATENT DOCUMENTS

| | | | | | |
|---|---|---|---|---|---|
| 1,303,531 | A | * | 5/1919 | Routson | 401/262 |
| 1,460,607 | A | * | 7/1923 | MacMichael | 401/19 |
| 1,524,008 | A | | 1/1925 | Anastasia | |
| 1,899,386 | A | | 2/1933 | Flosi | |
| 2,118,051 | A | * | 5/1938 | McNair | 401/266 |
| 2,361,407 | A | * | 10/1944 | Barlow et al. | 401/266 |
| 2,450,919 | A | | 10/1948 | Runnels | |
| 2,837,756 | A | * | 6/1958 | Henriksson | 401/21 |
| 2,930,384 | A | | 3/1960 | Strain et al. | |
| 2,962,743 | A | * | 12/1960 | Thomas | 401/266 |
| 3,072,953 | A | * | 1/1963 | Bunke | 401/132 |
| 3,488,126 | A | | 1/1970 | Avallone | |
| 3,775,014 | A | | 11/1973 | Rosborne | |
| 3,947,971 | A | | 4/1976 | Bauer | |
| 4,665,901 | A | | 5/1987 | Spector | |
| 4,674,903 | A | * | 6/1987 | Chen | 401/266 |
| 4,935,158 | A | | 6/1990 | Aszman et al. | |
| 4,969,225 | A | | 11/1990 | Schubert | |
| 4,983,061 | A | | 1/1991 | Demarest | |
| 5,131,773 | A | | 7/1992 | Gueret | |
| 5,904,151 | A | | 5/1999 | Gueret | |
| 6,082,919 | A | | 7/2000 | de Laforcade | |
| 6,099,184 | A | | 8/2000 | Koptis | |

FOREIGN PATENT DOCUMENTS

| | | |
|---|---|---|
| EP | 0 775 641 | 5/1997 |
| FR | 782 500 | 6/1935 |
| FR | 1 272 557 | 8/1961 |
| FR | 2 601 865 | 1/1988 |
| FR | 2 642 675 | 8/1990 |
| FR | 2 754 985 | 4/1998 |
| GB | 626 797 | 7/1949 |

OTHER PUBLICATIONS

Co–pending application No. 09/339,840; An Applicator for a Dispersible Substance, an Assembly Including Such an Applicator, and a Method, Jean–Louis H. Gueret, U.S. Filing Date: Jun. 25, 1999, Preliminary Filed: Apr. 25, 2001 (copy attached).

English language Derwent Abstract of FR 2 601 865, Jan. 29, 1988.

* cited by examiner

*Primary Examiner*—Gregory L. Huson
*Assistant Examiner*—Huyen Le
(74) *Attorney, Agent, or Firm*—Finnegan, Henderson, Farabow, Garrett & Dunner, L.L.P.

(57) ABSTRACT

An applicator assembly may comprise an application member comprising at least one face configured to apply product to a surface and may define a chamber having an opening in the at least one face. The applicator assembly may further comprise a holder configured to hold the product and to be removably mounted relative to the application member so as to permit the chamber to removably receive the product. The holder may be further configured such that the holder has a substantially fixed axial position with respect to at least a portion of the application member when the holder is mounted relative to the application member.

73 Claims, 6 Drawing Sheets

Fig. 7A
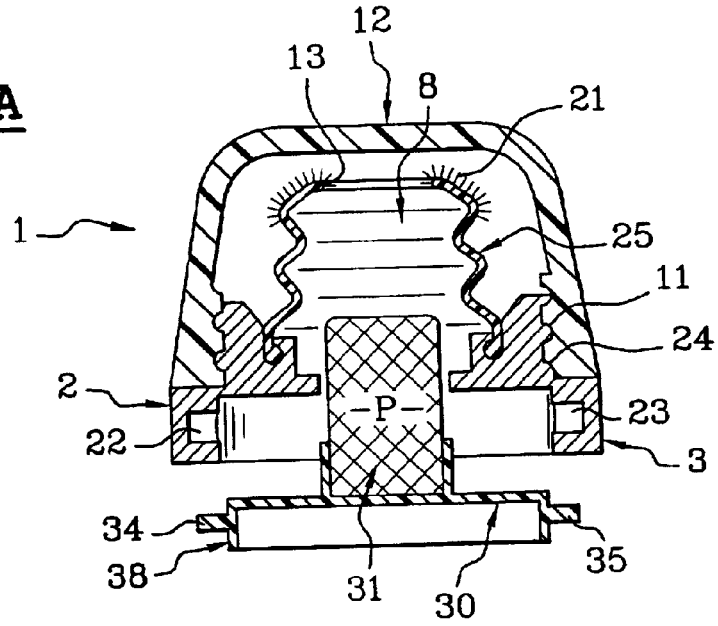
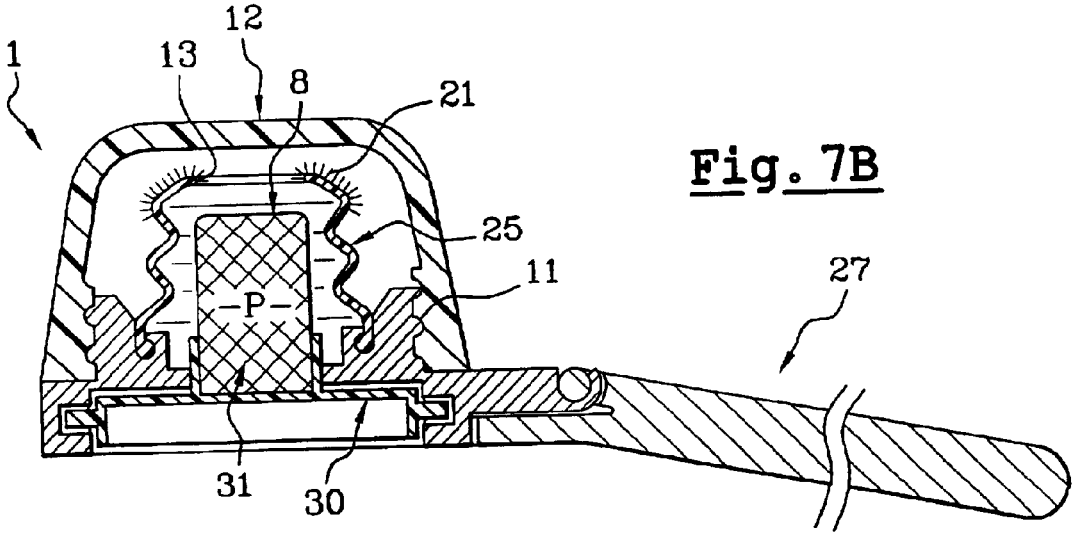
Fig. 7B

APPLICATOR ASSEMBLY, SYSTEM AND METHOD

The present invention relates to an applicator assembly that may be used for applying a product to a surface. For example, the applicator assembly may be used to apply a cosmetic product and/or a care product and/or a make-up product. More particularly, an applicator assembly of this sort may be used for applying a blush, a rouge, an eyeshadow, a face powder, a lip make-up product, such as lipstick, for example, a foundation, a care cream, a sun protection product, a self-tanning product, and/or a hair product, or the like, for example. More generally, it may be used for applying any friable product, for example. The invention also relates to an applicator system comprising at least one applicator assembly.

Various types of applicators are known and used for applying products, such as cosmetic and/or care products, for example, make-up products. Among others, applicators of the "matchstick" type are known. These devices may be in the form of a rod having one end which may become loaded with product by dipping or by using spray guns, for example. These devices may have the drawback of depositing too much product during application. Moreover, this type of applicator may not enable the applied product to be shaded off so as to obtain a desired look. Finally, the configuration of these applicators may cause them to be relatively fragile.

Applicators having a surface on which a product, such as a cosmetic and/or care and/or make-up product, for example, may be pressed or compacted also are known. One of the major drawbacks of these applicators may be their relatively low endurance. Generally, these applicators may be used as samples.

Applicators of the "puff" type also are known. These applicators may be used in combination with a case comprising at least one dish in which a product may be poured or compressed. These types of applicators may typically be in the form of powder compacts and may be relatively expensive.

Other types of applicators, including those of the polish-applicator type, also exist. In these applicators, the product to be applied may be contained in a tube on which a foam block or other similar application element may be mounted. The foam block may be pierced with a hole defining a channel communicating with the tube. In these applicators, the product may be brought to the application surface by exerting pressure on the walls of the tube so as to force the product to pass into the channel of the applicator and to bring it to the application surface. Apart from the size, these devices may not be suitable for other types of cosemetic and/or care and/or make-up products because of the difficulty in controlling and accurately dosing the applied product, for example.

French Patent No. 1 272 557, U.S. Pat. No. 1,899,386 and U.S. Pat. No. 2,450,919 describe applicators for a product, generally in the form of a powder, in which the powder is contained in a compartment made in a foam block and having a free end covered with a sieve in the form of a perforated sheet, a fabric or other screen-like type of material. In these devices, the powder is in loose form in the compartment. Such devices may not be suitable for products of higher consistency, such as lipsticks, for example.

The device described in U.S. Pat. No. 1,524,008, like those described in the U.S. Pat. Nos. 1,899,386 and 2,450,919, mentioned above, comprises a bottom forming an integral part of the sponge in which a pocket is made. The soap contained in this pocket is not secured to the pocket, which, in the course of use, may endow it with an increasingly high axial mobility.

French Pat. No. 782 500 discloses a shaving brush comprising a foam ring surrounding an end of a bar of soap held by a structure that is configured to move in an axial direction relative to the foam ring. In this device, the structure that holds the soap is configured to be mounted with respect to the foam ring. In use, both the structure holding the soap and the soap itself are configured to be moved relative to the foam ring in an axial direction so as to protrude the free surface of the soap beyond the free end of the foam ring. Neither the structure nor the soap have a substantially fixed axial position when the structure is mounted with respect to the foam ring. Due to the ability of the soap and structure to move axially in the mounted position, the soap may be able to extend past the free end of the foam ring even in a resting position, i.e., without any compression on the foam ring. In this way, the soap may not be protected from the external environment and may become damaged or dry out.

It may be desirable to offer consumers the possibility of choosing a desired product, such as a make-up product, for example, depending on the state of her skin, or the mood of the moment, for example. Differing products, for example products of differing types, differing colors, or differing textures may be provided for the user to select. Similarly, on changing products, or in a manner independent of changing products, it may further be desirable for the user to change application members. For example, a user may want to change the application surface and/or the compressibility characteristics of the application member, such as according to the desired softness, or, in the case of application of a make-up product, the desired look.

In conventional devices, these possibilities do not exist and the consumer, after having bought an applicator, typically applies the same product with the sample application member for every use. For a given product, a user may not be able to apply it in the manner she pleases, for example, depending on the desired result or depending on the location where the product is to be applied.

Producing relatively inexpensive applicator assembly, not having the drawbacks mentioned above may be desirable. Also, it may be desirable to supply an applicator assembly that may be adaptable, both with respect to the product to be applied and to the type of application member used to apply it.

Another desirable aspect may be to supply an applicator assembly that may permit, for a given product, differing application characteristics, for example, according to a desired result, and/or for a given application characteristic. Also, an applicator assembly that may permit the application of products of differing types and/or colors may be desirable.

It should be understood that the invention could be practiced without performing one or more of the aspects described above. Other aspects will become apparent from the detailed description which follows. As embodied and broadly described herein, one aspect of the invention includes an applicator assembly that may comprise an application member comprising at least one face configured to apply product to a surface. The application member may define a chamber having an opening in the at least one face. The applicator assembly may further comprise a holder configured to hold the product and to be removably mounted relative to the application member so as to permit the chamber to removably receive the product. The holder may be further configured such that the holder has a substantially fixed axial position with respect to at least a portion of the application member when the holder is mounted relative to the application member.

The "substantially fixed axial position" of the holder means that the holder, once mounted with respect to the application member, is not capable of moving in an axial direction relative to at least a portion of the application member. In other words, while the application member may move relative to the holder, for example via compression and/or expansion of the application member, the holder is fixed from moving axially relative to at least a portion of the application member. A holder having a "substantially fixed axial position" also includes a holder holding product and mounted with respect to the application member such that, in the absence of force, such as force exerted axially on the application member, the free surface of the product held by the holder can only be located below or substantially at the level of the application surface, substantially irrespective of the degree of mounting engagement of the holder with respect to the application member. In contrast, FR 782 500 does not have a product holder substantially axially fixed with respect to the foam ring because, for example in FIG. 3 of FR 782 500, the free surface of the product projects through the opening in the free end of the foam ring at least when there is a complete engagement between the threaded members.

According to yet another aspect, an applicator assembly may comprise an application member comprising at least one face configured to apply product to a surface. The application member may define a chamber having an opening in the at least one face. The applicator assembly may further comprise a holder configured to hold the product and to be removably mounted relative to the application member so as to permit the chamber to removably receive the product. The applicator assembly also may comprise a lid configured to removably cover at least a portion of the application member.

In an exemplary embodiment, when the holder holding the product is mounted relative to the application member in the substantially fixed axial position, in the absence of force, for example, force exerted axially on the application member, the free surface of the product may be located either entirely within the chamber or substantially at the level of the end of the chamber opening onto the application face, but may not protrude beyond the chamber out of the opening.

Thus, in the rest position, that is to say especially when the application member is not pressed against the surface to be treated, the product may be contained substantially within the chamber defined by the application member. This may offer beneficial protection of the product, such as with respect to the external environment.

Thus, according to certain exemplary embodiments, the totality of the product is contained substantially inside the structure formed by the application member and the product holder. This may differ from certain known applicator assemblies, for example, products such as nail polishes, in which a foam applicator through which an axial hole passes is supplied with product from an attached reservoir, such as a reservoir in the form of a compressible tube.

The applicator assembly may further comprise a support member and the application member may be mounted on the support member, for example, the application member may be either mounted fixedly or removably on the support member. The application member may be mounted onto the support member via welding, bonding, crimping, and/or any other suitable mounting mechanisms.

The holder may be configured to be removably engaged with the support member. For example, the holder and the support member may be removably engaged via mutually cooperative engagement mechanisms. For example, the holder and the support member may be configured to be engaged via one of screw fastening, snap fastening, and bayonet fastening. In an exemplary embodiment, the holder may comprise screw threading configured to engage screw threading on the support member. The support member may have screw threading provided on an interior surface portion thereof, and the holder may comprise screw threading on an exterior surface portion thereof. The support member and the holder may be substantially axially fixed relative to each other when the support member and the holder are engaged with each other.

The support member may be configured to be grasped for holding the application member. The assembly may further comprise a grasping handle. The grasping handle may be associated with application member, for example, either mounted removably or fixedly with respect to the application member. This may facilitate the application of the product to the desired location. Alternatively, the handle may be removably engageable or fixedly engageable with either the support member or the product holder.

According to an exemplary embodiment, the application member is at least partially compressible, for example partially elastically compressible. The application member may comprise at least one block of foam with open, semi-open, or closed cells. The application member may be a made of polyvinyl chloride (PVC), polyurethane, polyether, polyester or of an elastomer of the SBR (styrene butadiene rubber), NBR (nitrile butadiene rubber), silicone or nitrile type, or other similar materials.

According to an exemplary embodiment, the application member may comprise a plurality of foam blocks. The plurality of foam blocks may be concentrically disposed around the chamber. Alternatively, the plurality of foam blocks may be stacked vertically upon each other and each of the foam blocks may define a hollow portion defining part of the chamber.

The application member may be configured to compress in either uniform or preferential manner. The application member may comprise one or more grooves formed around all or part of the chamber on an exterior surface of the application member.

According to another exemplary embodiment, the application member may comprise a portion forming a bellows.

At least a portion of the application member, for example an exterior surface portion, may be covered with flocking, a textile, and/or a screen. This may enhance the application of the product, and may increase the softness of the application member against the surface to which product is being applied.

The chamber may extend substantially entirely through a dimension, such as the height, for example, of the applicator member and substantially the entire cross-sectional area of the chamber may open onto the application face via the opening. In this way, the opening may have a cross-section substantially identical to the cross-section of the chamber (at least in its part adjacent to the opening). In other words, in the application position, the product may not be covered by a sieve or other perforated or porous element capable of isolating it from the surface on which the product is being applied. The chamber may have a substantially constant cross-section.

Because of the removable nature of the support member and the product holder, the consumer may choose to apply a given product in varying ways, for the purpose especially of obtaining a differing make-up look. Similarly, with the same applicator assembly, the user may choose to change the color, the type, and/or the texture of the product to be applied, simply by changing the product holder to be engaged with the support member carrying an application member. Between two successive applications of two differing products via the same application member, the application member may be rinsed so that the application of the second product is not polluted by any residues from the first product.

Similarly, since it is placed fixedly on the product-holder element, the product may be in a position, fixed at least axially, inside the chamber defined by the application member. As a result, the application may be carried out by displacing (e.g., via compression/decompression) the application face of the compressible application member surrounding the free end of the product. For example, the application member may be compressed by pressing the at least one application face against a surface to which the product is to be applied. Such displacement may contribute selectively to "uncovering" the product, permitting the free surface thereof to be substantially at the level or at least slightly beyond the chamber above the application face, for the purpose of its direct application or a surface to be treated. In an exemplary embodiment, the product may be immobilized axially by anchoring means (such as fins or ribs, for example) provided on a bottom of the product holder or on its sides. By axially fixing the product inside the chamber, a more accurate dosage of the applied product may be obtained.

The applicator assembly may, when the product is received in the chamber, be configured to be repositioned between a first position wherein the product does not protrude beyond the chamber out of the opening, and a second position wherein at least a portion of the product either protrudes beyond the chamber out of the opening or is substantially level with the opening. The assembly may be placed in the second position by at least partially compressing the application member. In the first position, the application member may be substantially uncompressed.

The product may be poured or compacted inside the chamber defined by the application member. It also may be poured or compacted beforehand, for example, in a cupule formed by the product holder. The product holder and the support member may then be assembled at a later time.

The product may be substantially in the form of a paste, such as a paste obtained by mixing a particulate solid phase, either with an aqueous phase, or with a binder, for example an oily phase in a solvent. It may also be in the form of a product based on hot-melt waxes or of a gel which may be poured in a hot state. Depending on the type of composition chosen, the solidification may take place, either after molding, either by water or solvent evaporation, by cooling, and/or by chemical reaction. The product may be an anhydrous paste, poured hot or cold, for example into a flexible mold of a shape adapted substantially to the shape of the stick to be obtained. Alternatively, the product to be poured may contain, apart from colored pigments, fillers, and binders, calcium sulfate hemihydrate ($CaSO_4.½H_2O$) and enough water to obtain a pourable mixture. The solidification may take place by formation of calcium sulfate dihydrate ($CaSO_4.2H_2O$). After the composition has set, the stick can be unmolded and mounted on the product holder. Alternatively, the product holder may itself define part of the mould into which the composition may be directly poured. Of course, the product may be in a variety of other forms, including solids, semi-solids, gels, capsules, and liquids, and the exemplary embodiments above are not intended to be limiting.

In yet another alternative, the chamber may form the mold into which the product composition may be poured directly. To this end, after having positioned a removable lid over at least the application face of the application member, and turned the assembly upside down, the composition may be poured into the chamber defined by the application member via a suitable orifice provided in the product holder. A cap, for example, a snap-fastened, bonded, and/or welded cap, may then be used to close off the orifice of the product holder.

In an exemplary embodiment, the application member may be capable of being compressed over a height such that, whatever the level of the product in the chamber, the application face may be lowered to the level of the free surface of the product, so as to allow the application of substantially all the product, the product being placed fixedly in the chamber.

In this manner, in order to apply the product, the at least one face is placed on the surface to be treated. By exerting pressure on the application member, it may become at least partly compressed, and the product may come into contact with the surface to be treated. Then, by means of small circular movements for example, the product may be deposited and spread on the surface. By releasing the pressure exerted on the application member, the free surface of the product may return inside the chamber. Only the application face of the application element may remain in contact with the surface to be treated. This free application face may then be used to complete the spreading of the product without adding more products, and/or to shade off the product on the surface.

A stick of product may be mounted on a rigid or semi-rigid bottom, comprising attachment means capable of engaging, for example by snap-fastening, bayonet fastening, or screwing, with additional means provided on a rigid or semi-rigid base of the support member. The base of the support member and the bottom of the product holder can be obtained by molding a thermoplastic such as a polyethylene or a polypropylene, for example.

According to an exemplary embodiment, the applicator assembly also comprises a lid, for example a removable lid, configured to cover the at least one face. A lid of this sort may be attached either on the support member or on the product holder. The lid can be attached via screwing, snap-fastening, and/or a bayonet system, for example.

The product to be applied may be a make-up product. For example, the product may be a blusher, a rouge, a face powder, an eyeshadow, a lipstick, a lipgloss, a lip make-up, a foundation, a care product, sun protection product, a hair product, a self-tanning product, or other similar products. Further, the product may be intended for application to hair, skin, fingernails, or toenails.

According to another aspect, an applicator system may comprise at least one applicator assembly of the types discussed above and at least one additional application member. Alternatively, an applicator system may comprise at least one applicator assembly and at least one additional holder.

A system of this sort may comprise a plurality of application members having differing application faces and/or compressibilities. Further, a system of this sort may comprise a plurality of product holders holding products having a differing characteristic, such as product type and/or color, for example.

The system may further comprise a case configured to hold the applicator assembly and the at least one additional application member or holder.

Yet another aspect includes a method of applying a product to a surface, the method may comprise providing an applicator assembly of any of the types discussed above wherein a product is held in the holder and the holder is mounted with respect to the application member such that the chamber receives the product. The method may further comprise placing the at least one face of the application member in contact with the surface and placing the product in contact with the surface.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

The placing of the at least one face in contact with the surface may comprise compressing the application member. The compressing of the application member may cause at least a portion of the product to one of protrude from the chamber opening and be substantially level with the chamber opening so as to enable the placing of the product in contact with the surface.

Another aspect includes an applicator system comprising a plurality of application members. Each application member may comprise at least one face configured to apply product to a surface, and each application member may define a chamber having an opening in the at least one face. The applicator system may further comprise at least one holder configured to hold the product and to be removably mounted relative to each of the application members so as to permit each of the chambers to removably receive the product.

Each of the at least one faces may have a differing characteristic. For example, each of the application members may have a differing compressibility.

The applicator system may further comprise at least one additional holder. Each of the holders may hold a product having a differing characteristic. For example, the differing characteristic may be chosen from at least one of product type and product color. In an exemplary embodiment, each of the holders may hold a make-up product.

The applicator system may further comprising a case configured to hold the plurality of application members and the at least one holder.

In yet another aspect, an applicator system comprises at least one application member comprising at least one face configured to apply product to a surface. The at least one application member may define a chamber having an opening in the at least one face. The applicator system may further comprise a plurality of holders configured to hold the product and to be removably mounted relative to the at least one application member so as to permit the chamber to removably receive the product.

The applicator system may further comprise at least one additional application member, wherein each of the at least one faces may have a differing characteristic. Each of the application members may have a differing compressibility.

Each of the holders may hold a product having a differing characteristic, such as a differing product type and/or product color, for example. In an exemplary embodiment, each of the holders may hold a make-up product.

The applicator system may further comprise a case configured to hold the at least one application member and the plurality of holders.

Besides the structural and procedural arrangements set forth above, the invention could include a number of other arrangements, such as those explained hereinafter. It is to be understood that both the foregoing description and the following description are exemplary. The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is a perspective view of an exemplary embodiment of an applicator assembly shown in an unassembled configuration;

FIG. 7A is a cross-sectional view of another exemplary embodiment of an applicator assembly;

FIG. 7B is a cross-sectional view of another exemplary embodiment of an applicator assembly.

Figure 1:
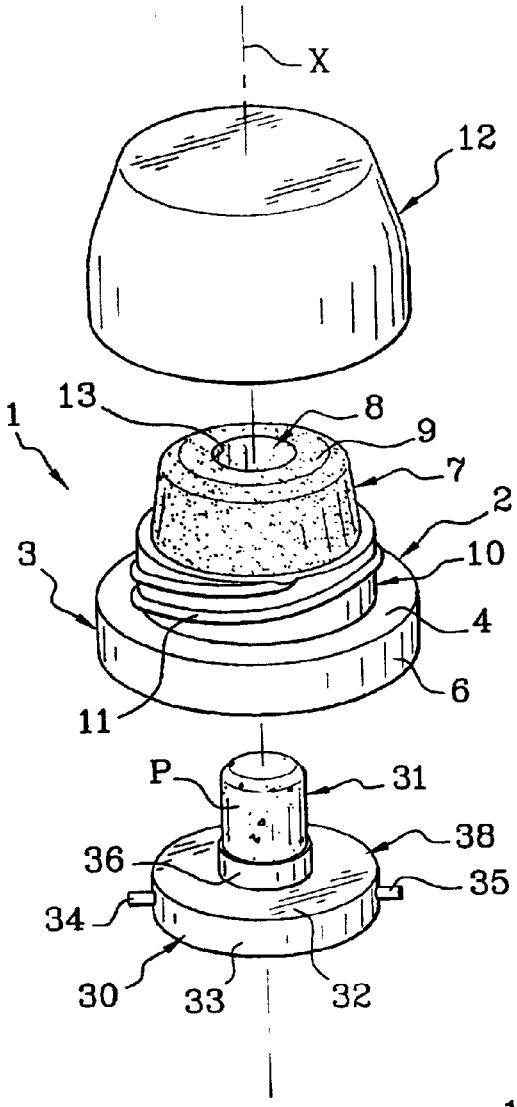

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes and/or superscripts are used to refer to similar parts.

FIGS. 1, 2, 3A, 3B and 4A–4C, to which reference is now made, illustrate an applicator assembly according to an exemplary embodiment. The assembly 1 may have a longitudinal axis X and may comprise a support member 2 for holding an application member 7 and a product holder 30 for holding a unit 31 of product P.

Figure 2:
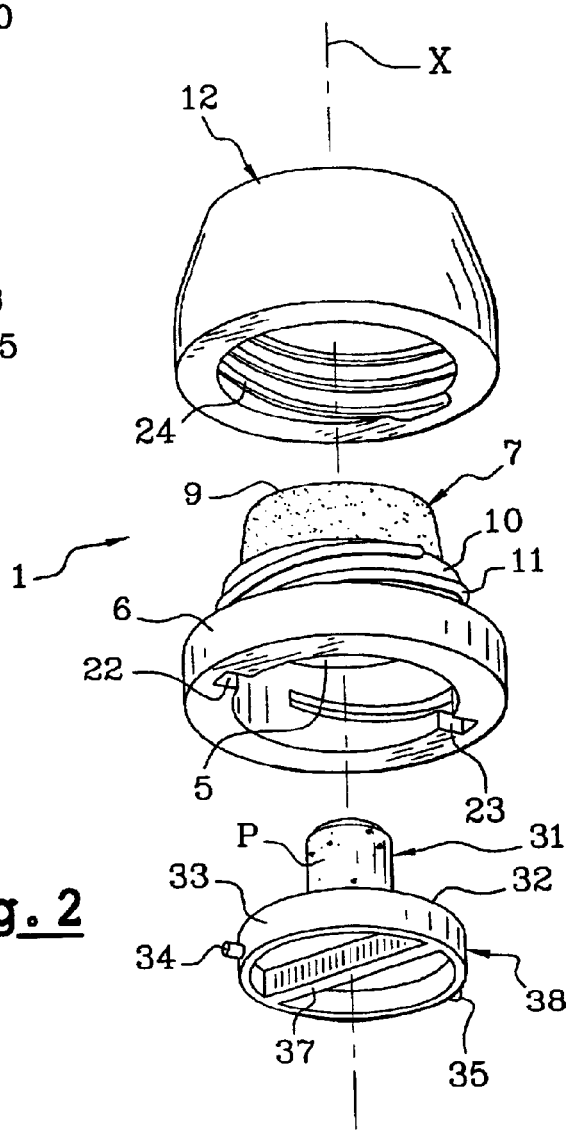
FIG. 2 is another perspective view of the applicator assembly of FIG. 1.

The support member 2 may comprise a base 3 formed from a transverse wall 4, through which a hole 5 passes. The hole 5 may have a cross-section slightly greater than the cross-section of an element of product 31, for example substantially in the form of a stick as shown, placed on the product holder 30. A lateral skirt 6 may depend from the transverse wall 4. The free end of the lateral skirt 6 opposite the transverse wall 4 may define an opening, as shown in FIG. 2.

An application member 7, which may be in the form of a foam block, may define an axial chamber 8 of substantially cylindrical shape. The chamber 8 may have a cross-section similar to the cross-section of the hole 5. The application member 7 may be bonded on the surface of the transverse wall 4, opposite the skirt 6. The chamber 8 may extend over substantially the entire axial height of the application member 7. The chamber 8 may open out via an opening 13 formed substantially in the center of an application face 9 of the foam block, substantially at the opposite end of the transverse wall 4. The opening 13 may have a cross-section substantially the same as the cross-section of the chamber 8.

On the side opposite the lateral skirt 6, the transverse wall 4 may carry a skirt 10 whose outer surface may be provided with threading 11 capable of engaging with corresponding threading 24 provided on the inner surface of a removable lid 12.

The product holder 30 may comprise a bottom 38 formed by a transverse wall 32 connected to a lateral skirt 33. The lateral skirt 33 may have an external cross-section slightly less than the internal cross-section of the lateral skirt 6 of the support member 2. The lateral skirt 33 may open at its end opposite the transverse wall 32. Two diametrically opposed lugs 34, 35 may be placed on the outer surface of the lateral skirt 33, so as to define, with corresponding compartments 22, 23 provided on the inner surface of the lateral skirt 6, a bayonet fastening system. Other fastening systems, such as a conventional screw fastening system and/or a conventional snap fastening system, for example, also may be used.

On the side of the transverse wall 32, opposite the lateral skirt 33, an axial chimney 36 may be formed. The chimney 36 may have a cross-section less than the cross-section of the lateral skirt 33 and slightly less than the cross-section of the axial chamber 8. The axial chimney 36 may define, with a corresponding portion of the wall 32, a cupule capable of accommodating a stick 31 of a product P, such as a foundation, for example, or other product. The stick 31 may be held inside the cupule by crimping, for example. Also, fin or groove (not shown), also may be provided in the bottom or on the sides of the cupule to improve the fastening of the stick 31 in the cupule.

A wall 37 may cut the cross-section of the lateral skirt 33 into two substantially identical parts, and form a key to allow, for example by a relative rotation by a few degrees of the product holder 30 with respect to the support member 2, the engagement of the lugs 34, 35 of the bayonet system with the corresponding chambers 22, 23 provided on the support member 2. The key 37 may also facilitate the dismantling of the two parts 2, 30 of the applicator assembly 1.

The base 3 of the support member 2 and the bottom 38 of the product holder 30 may be obtained by molding of polypropylene, for example, or other suitable materials.

Thus, an assembly 1 may be formed comprising a support member 2 and a product holder 30. These two portions may be separated either to change the product associated with a given application member, and/or to change the application member associated with a given product, as desired.

Figure 3A:
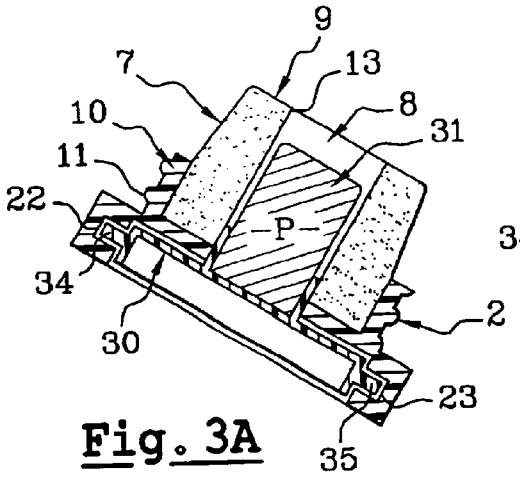
FIG. 3A is a cross-sectional view of an exemplary embodiment of an applicator assembly in a first position wherein the applicator assembly is not in use for applying product.

In the mounted position, as shown in FIG. 3A, the stick 31 may be placed inside the chamber 8 defined by the application member 7. The free surface of the product P may be positioned below the application face 9. That is, the product P may be positioned such that it is entirely within the chamber 8. Alternatively, the free surface of the product P may be level with the opening 13. By way of example, the initial height of the stick of product may be about 10 mm, for a chamber 8 whose height is about 13 mm when the application member 7 is uncompressed.

Figure 3B:
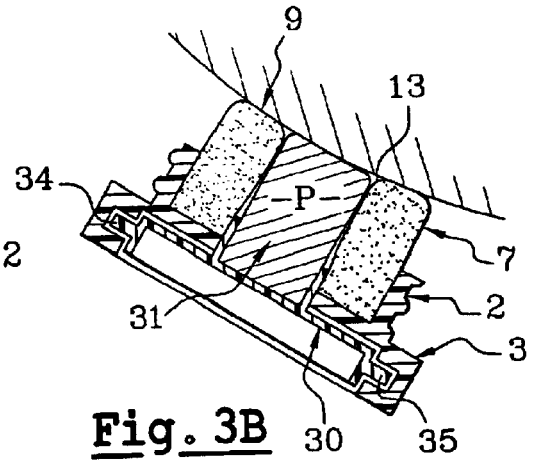
FIG. 3B is a cross-sectional view of the applicator assembly of FIG. 3A in a second position wherein the applicator assembly is in use for applying product to a surface.

For the purpose of applying product, as illustrated in FIG. 3B, the application member 7 may be applied to a surface, for example, skin. This may cause a compression (at least partial) of the foam application member 7 until the free surface of the product P is essentially at the level of the opening 13 in the application face 9 or at least slightly protruding out of the opening 13. The stick 31 of product P may then contact the skin, the application face 9 assisting in a good distribution of the product P over the skin. After having released the pressure exerted on the application member 7, the user may then shade off the applied product with the application face 9. In this manner, the product P may be dosed and applied relatively accurately and as desired, according to the pressure exerted on the application member 7, and according to the time during which the pressure is exerted. In the course of use, the level of product P in the chamber 8 may decrease, until the product P is substantially completely used up.

When the user desires to obtain a different make-up result, such as by applying a thicker layer of product P, for example, the user may turn the key 37 of the product holder 30 so as to separate the lugs 34, 35 from their respective compartments 22, 23 and to be able to separate the support member 2 from the product holder 30. The user may then take a different support member 2, with an application member 7 having a different surface condition, and/or a different density, and mount it with the same product holder 30.

Figure 4A:
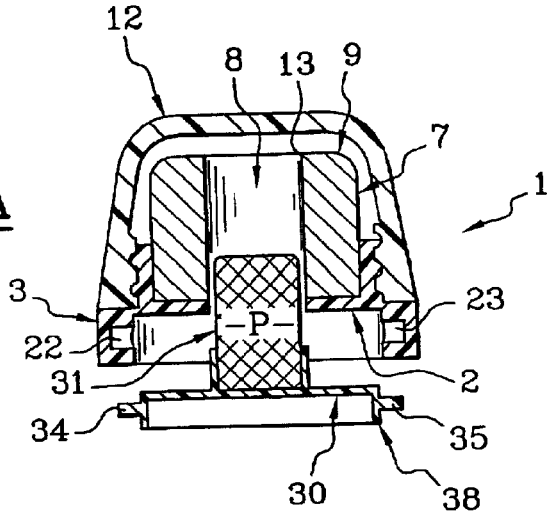
FIG. 4A is a cross-sectional view of an exemplary embodiment of an applicator assembly.
Figure 4B:
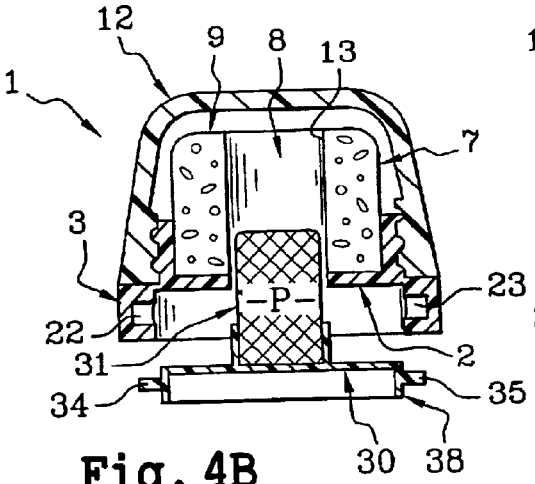
FIG. 4B is a cross-sectional view of another exemplary embodiment of an applicator assembly.

FIG. 4A shows an applicator assembly 1 of the type described above, with a stick 31 of foundation of a given color to be applied using an application member 7 formed from a foam block 6 with relatively low compressibility. In this way, a relatively thin layer of the foundation may be applied to a first location of the user's face. In FIG. 4B, the product holder 30 is substantially similar to that of FIG. 4A, except that the support member 2 has been replaced by a support member with an application member 7 formed from a less dense foam block 6. This may permit application of a thicker layer of the same product on another part of the face or skin, for example.

Figure 4C:
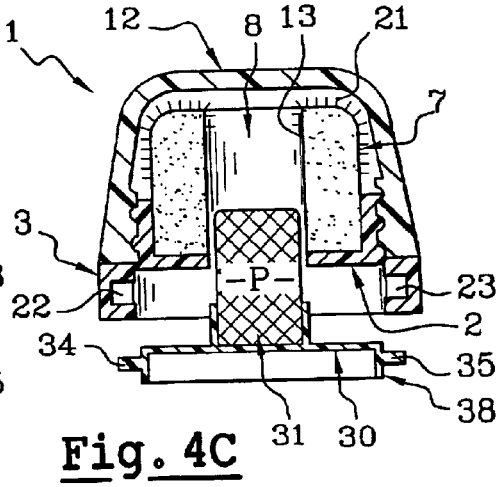
FIG. 4C is a cross-sectional view of yet another exemplary embodiment of an applicator assembly.

In FIG. 4C, the support member 2 may again be changed and replaced by a support member 2 having yet another different density and having an application face 9 comprising flocking 21. This may endow a "finish" to the locations where the product has been applied as compared to the applicator assemblies of FIGS. 4A and 4B.

Figure 5A:
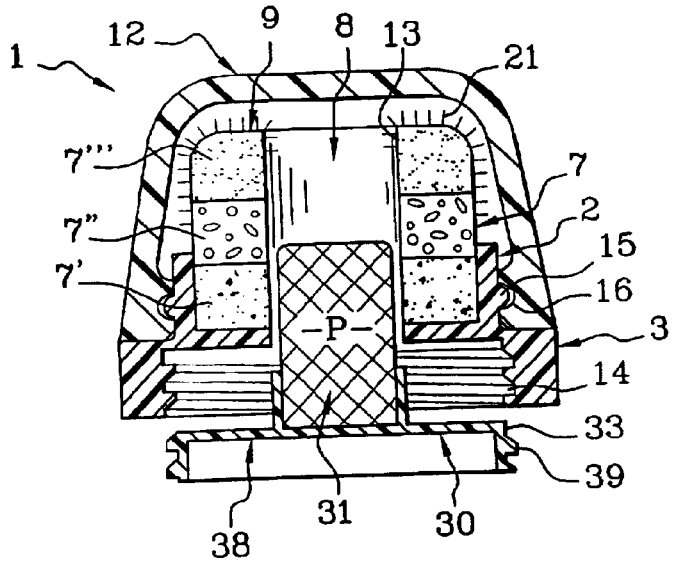
FIG. 5A is a cross-sectional view of another exemplary embodiment of an applicator assembly.

The exemplary embodiment of FIG. 5A differs from the previous embodiment in that the support member 2 may be mounted by screwing onto the product holder 30. To this end, the product holder 30 may comprise, on the outer surface of the lateral skirt 33, screw threading 39 capable of engaging with corresponding screw threading 14 provided on the inner surface of the lateral skirt 6 of the support member 2. The lid 12, instead of being screwed onto the support member 2, may be mounted removably by snap-fastening, by means of a flange 15/groove 16 arrangement.

Furthermore, the application member 7 placed on the support member 2 may be formed from an axial stack of annular foam blocks 7', 7", 7'". Each of the blocks may have a differing hardness and/or density and/or compressibility, so as to potentially allow subtle differences in the application of the product. The stack may be obtained by molding or by bonding the various stacked blocks. All of the blocks of the stack do not have to be elastically compressible. For example, the block 7''' adjacent to the application surface 9 may be formed of a sintered rigid thermoplastic, while the other blocks 7' and 7'' may be made of elastically compressible foam. Other combinations of blocks also may be used and are envisioned as being within the scope of the invention.

Figure 5B:
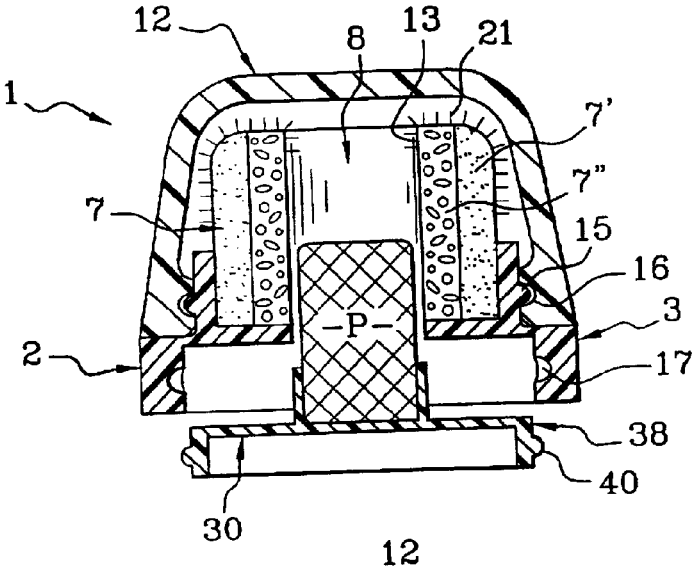
FIG. 5B is a cross-sectional view of yet another exemplary embodiment of an applicator assembly.

The exemplary embodiment of FIG. 5B is distinguished from the previous one in that the blocks 7', 7'', instead of being axially stacked, are placed in a concentric manner around the chamber 8. The support member 2 may be removably mounted on the product holder 30, for example by snap-fastening, via a flange 40/groove 17 arrangement. In the same way, as for the previous exemplary embodiment, the removable lid 12 may be mounted by snap-fastening on the support member 2.

Figure 5C:
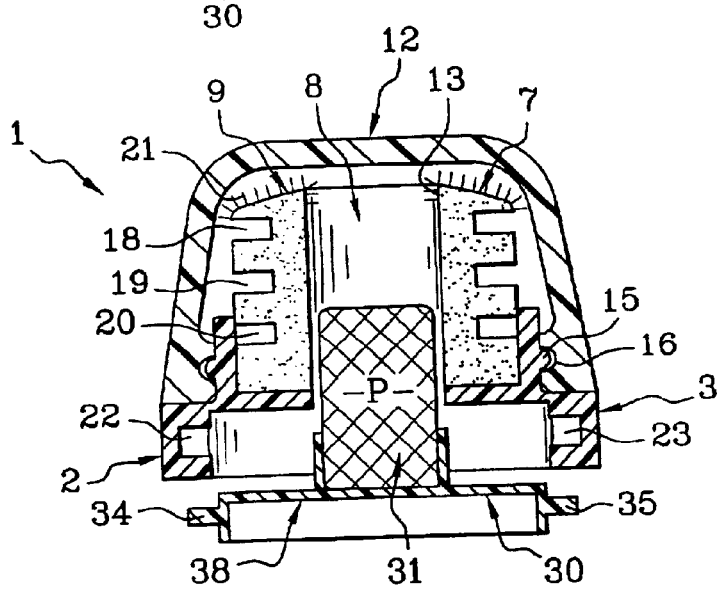
FIG. 5C is a cross-sectional view of yet another exemplary embodiment of an applicator assembly.

In the exemplary embodiment of FIG. 5C, the application member 7 comprises a plurality of peripheral grooves 18, 19, 20 extending all around the chamber 8, and placed at differing axial levels. Such grooves may make it possible to promote the compression of the application member 7, when the application face 9 is pressed against the surface to which product is to be applied. As a result, the softness of the application may be increased. This characteristic may be particularly desirable for sticks of relatively small cross-section and that are relatively long, such as lipsticks, for example. The product holder 30 may be removably fastened to the support member 2 by means of a bayonet system (22, 23, 34, 35) in accordance with that of the embodiment of FIGS. 1, 2, 3A, 3B and 4A–4C. Furthermore, the application face 9 may be covered with a flocking coating 21, made, for example from, nylon fibers, so as to potentially further improve the softness of the application.

Figure 6A:
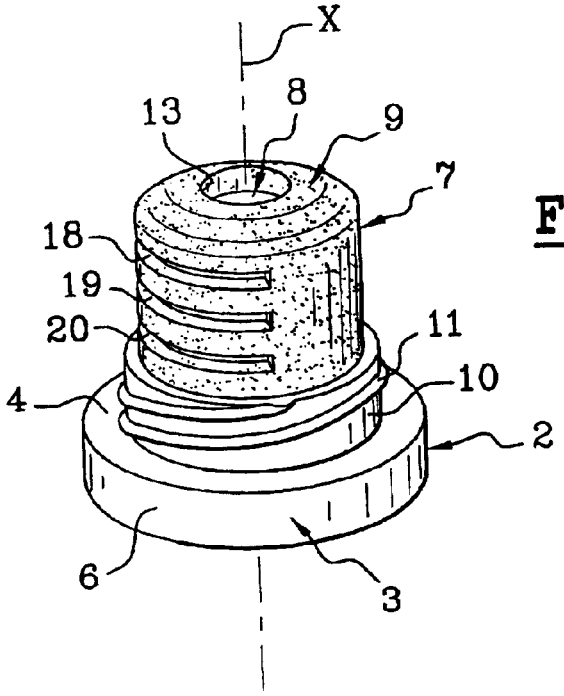
FIG. 6A is a perspective view of another exemplary embodiment of an applicator assembly.
Figure 6B:
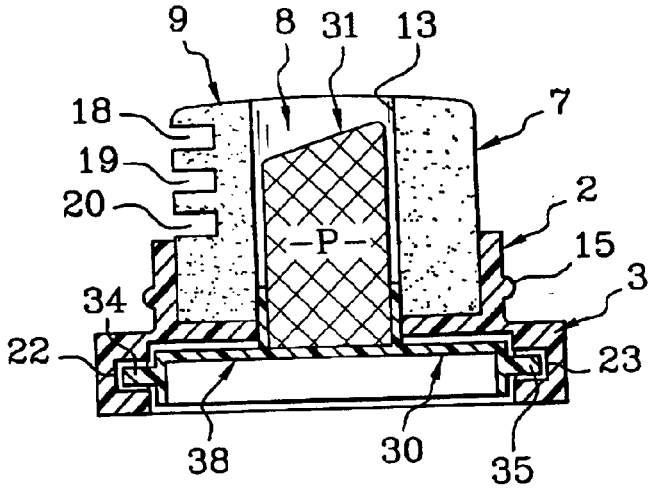
FIG. 6B is a cross-sectional view of the applicator assembly of FIG. 6A in a first position wherein the assembly is not in use for applying product.
Figure 6C:
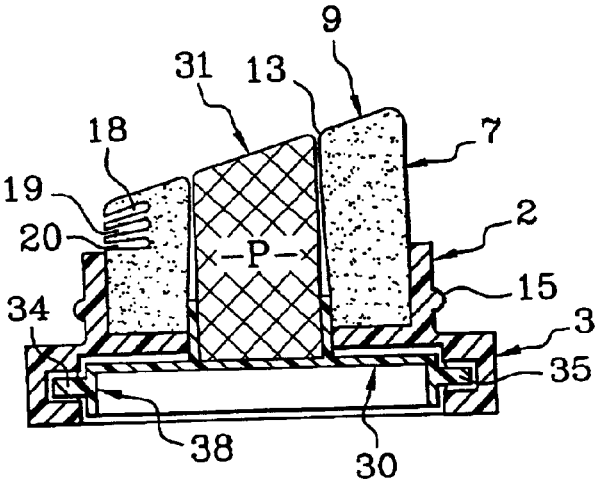
FIG. 6C is a cross-sectional view of the applicator assembly of FIG. 6A in a second position wherein the assembly is in use for applying product.

In the exemplary embodiment of FIGS. 6A–6C, unlike the previous embodiment, the grooves 18, 19, 20 lie only over a portion, for example half, of the periphery of the application member 7 so as to allow, as illustrated in FIG. 6C, an increased deformation of the side in which such grooves 18, 19, 20 are made. A configuration of this sort may be suitable when the free surface of the product stick 31 forms a bevel. In this case, the grooves of preferential deformation 18, 19, 20 may be placed facing the lower-height half of the stick 31.

In the exemplary embodiment of FIG. 7A, the application member mounted on the support member 2 may be in the form of an annular element 25. The body of the annular element 25 may form, on at least part of its height, a bellows. An element of this sort forming a bellows may be obtained by molding an elastomeric material or a low-density polyethylene, for example. In the exemplary embodiment of FIG. 7A, the application surface formed by the upper portion of the bellows may be covered with a flocking coating 21, comprising rayon fibers, for example.

The exemplary embodiment of FIG. 7B is distinguished from the embodiment of FIG. 7A in that the support member 2 may be secured to a removable grasping handle 27. The grasping handle 27 may have a substantially elongate shape and an orientation substantially perpendicular to the longitudinal axis of the chamber 8. The sleeve 27 may be removably fastened to the support member 2, for example by snap-fastening (as shown) or other fastening mechanisms. As an alternative, the handle 27 could be attached permanently to the support member 2 or attached, either permanently or removably, to the product holder 30.

Figure 8:
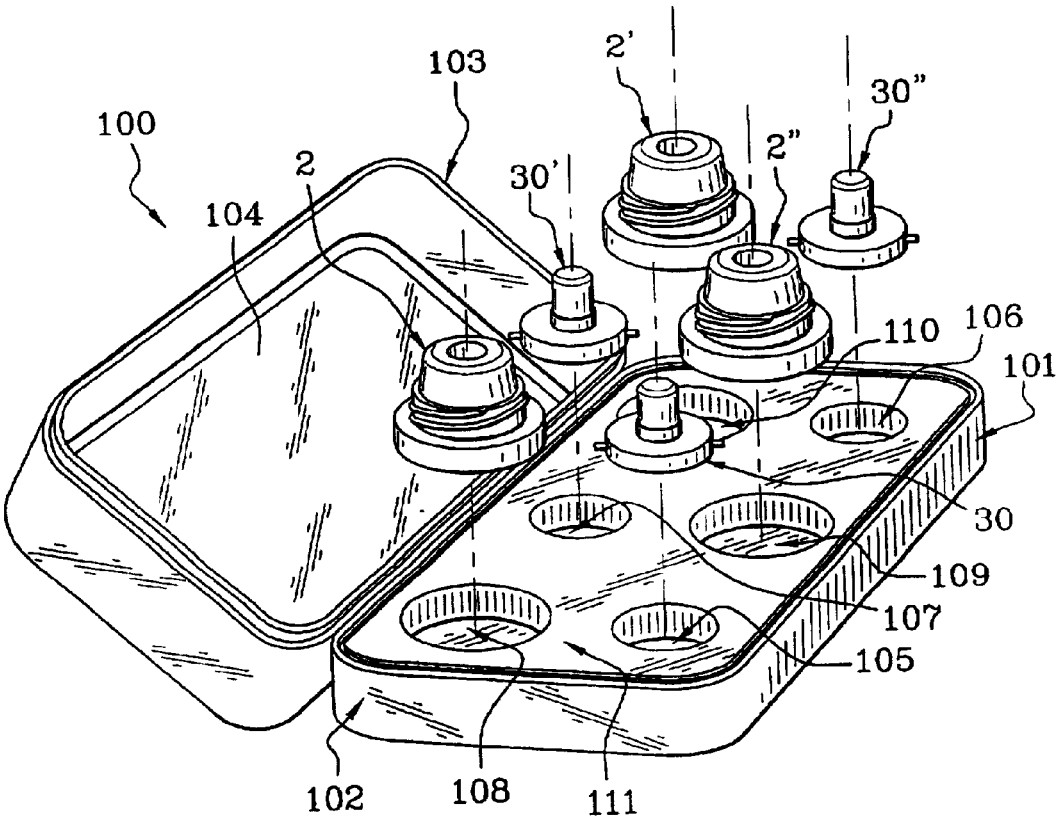
FIG. 8 is a perspective view of an exemplary embodiment of an applicator system.

FIG. 8, to which reference is now made, shows an exemplary embodiment of an applicator system 100. The system 100 may comprise a case 101 comprising a bottom 102 on which a cover 103 may be hinged. In the exemplary embodiment shown, a mirror 104 may be placed on the inner surface of the cover 103, so as to enhance the application of the product, such as a make-up product for example.

A base 111 defining a plurality of hollows 105–110 may be placed in the bottom of the case. The compartments 105–107 may be designed to accommodate a plurality, for example three, product holders 30, 30', 30''. Each product holder 30, 30', 30'', may carry a product of color, texture and/or type that are unique to the particular product holder. The compartments 108–110 are designed to accommodate three support members 2, 2', 2''. Each support member 2, 2', 2'' may carry an application member having application characteristics that differ from the other application members.

The consumer may select from these batches of support members 2, 2', 2'' carrying differing application members and product holders 30, 30', 30'' holding differing products so as to select an application member/product pair that may be suitable for the application the user desires. It is of course understood that, after each application, the application member can be rinsed, for example by passing it under running tap water, so as to clean it and prevent the application of a given product being soiled by any residues from a different product applied beforehand by means of the same applicator.

Though the various applicator assemblies disclosed have been described in conjunction with their use for applying cosmetic and/or care and/or make-up products, it should be understood that in its broadest aspects, the applicator assemblies could be used to store and dispense many other types of products, such as shoe polishes, furniture polishes, finishing products, varnishes, paints, etc. Furthermore, the sizes of various structural parts and materials used to make these parts are illustrative and exemplary only and one of ordinary skill in the art would recognize that these materials and sizes can be changed as necessary to product different effects or desired characteristics of the dispensing assembly.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed is:

1. An applicator assembly, comprising:

an application member comprising at least one face configure to apply product to a surface, the application member defining a chamber having an opening in the at least one face;

a holder configured to hold the product and to be removably mounted relative to the application member so as to permit the chamber to removably receive the product, the holder being further configured such that the holder has a substantially fixed axial position with respect to at least a portion of the application member when the holder is mounted relative to the application member;

wherein the applicator assembly further comprises the product, wherein the product is held by the holder, and wherein the product is intended for application to one of hair, skin, a fingernail, and a toenail.

2. The applicator assembly of claim 1, wherein the chamber comprises a passage extending substantially entirely through a dimension of the application member.

3. The applicator assembly of claim 1, wherein the application member is at least partially compressible.

4. The applicator assembly of claim 3, wherein the application member is at least partially elastically compressible.

5. The applicator assembly of claim 1, wherein the holder is configured to hold product substantially in the form of a stick.

6. The applicator assembly of claim 1, further comprising a support member, wherein the application member is mounted on the support member.

7. The applicator assembly of claim 6, wherein the application member is fixedly mounted on the support member.

8. The applicator assembly of claim 7, wherein the application member is mounted to the support member by at least one of welding, bonding, snap-fastening, and crimping.

9. The applicator assembly of claim 6, wherein the holder is configured to be removably engaged with the support member.

10. The applicator assembly of claim 9, wherein the holder and the support member are configured to be removably engaged via one of screw-fastening, snap-fastening, and bayonet fastening.

11. The applicator assembly of claim 9, wherein the holder and the support member comprise mutually cooperative engagement mechanisms for engaging the support member and the holder.

12. The applicator assembly of claim 11, wherein the holder comprises screw threading configured to engage with screw threading on the support member.

13. The applicator assembly of claim 12, wherein the support member comprises an interior surface portion and the screw threading on the support member is disposed on the interior surface portion.

14. The applicator assembly of claim 11, wherein the holder comprises an exterior surface portion and the screw threading on the holder is disposed on the exterior surface portion.

15. The applicator assembly of claim 9, wherein the support member and the holder are substantially axially fixed relative to each other when the support member and the holder are engaged with each other.

16. The applicator assembly of claim 6, wherein the support member is configured to be grasped for holding the application member.

17. The applicator assembly of claim 1, wherein, when the product is received in the chamber, the assembly is configured to be repositioned between a first position wherein the product does not protrude beyond the chamber out of the opening, and a second position wherein at least a portion of the product one of protrudes beyond the chamber out of the opening and is substantially level with the opening.

18. The applicator assembly of claim 17, wherein the assembly is configured to be placed in the second position by at least partially compressing the application member.

19. The applicator assembly of claim 18, wherein the application member is configured to be compressed by pressing the at least one face against a surface to which the product is to be applied.

20. The applicator assembly of claim 17, wherein the application member is substantially uncompressed when the assembly is in the first position.

21. The applicator assembly of claim 1, wherein the chamber has a substantially constant cross-section.

22. The applicator assembly of claim 21, wherein substantially the entire cross-sectional area of the chamber opens out onto the at least one face via the opening.

23. The applicator assembly of claim 1, further comprising a lid configured to cover the at least one face.

24. The applicator assembly of claim 23, wherein the lid is removable from the at least one face.

25. The applicator assembly of claim 1, wherein the application member comprises at least one block of foam having one of open cells, semi-open cells, and closed cells.

26. The applicator assembly of claim 25, wherein the application member comprises a plurality of foam blocks.

27. The applicator assembly of claim 26, wherein the foam blocks are concentrically disposed around the chamber.

28. The applicator assembly of claim 26, wherein the foam blocks are stacked vertically upon each other.

29. The applicator assembly of claim 28, wherein each of the foam blocks defines a hollow portion defining part of the chamber.

30. The applicator assembly of claim 1, wherein the application member is made of a material chosen from polyvinyl chlorides, polyurethanes, polyethers, polyesters, elastomers of styrene butadiene rubber, elastomers of nitrile butadiene rubber, elastomers of silicone, and elastomers of nitrile.

31. The applicator assembly of claim 1, wherein the application member is configured to be one of uniformly and preferentially compressed.

32. The applicator assembly of claim 1, wherein the application member comprises at least one groove formed on at least a portion of the application member.

33. The applicator assembly of claim 32, wherein the at least one groove is on an exterior surface of the application member.

34. The applicator assembly of claim 33, wherein the at least one groove extends at least partially around the chamber.

35. The applicator assembly of claim 34, wherein the at least one groove surrounds the chamber.

36. The applicator assembly of claim 1, wherein the application member comprises bellows.

37. The applicator assembly of claim 1, wherein the application member comprises one of flocking, a textile, and a screen on an exterior surface portion of the application member.

38. The applicator assembly of claim 1, further comprising a grasping handle.

39. The applicator assembly of claim 38, wherein the grasping handle is configured to be associated with the application member.

40. The applicator assembly of claim 39, further comprising a support member configured to hold the application member, wherein the grasping handle is configured to be one of removably engaged and fixedly engaged with the support member.

41. The applicator assembly of claim 1, wherein the product is chosen from blushes, face powders, eyeshadows, lip make-ups, rouges, foundations, care products, sun protection products, self-tanning products, and hair products.

42. The applicator assembly of claim 1, wherein the product comprises a makeup product.

43. The applicator assembly of claim 1, wherein the holder is configured to fixedly hold the product.

44. An applicator system comprising: the applicator assembly of claim 1; and at least one additional application member.

45. The applicator system of claim 44, wherein each of the application members has at least one face configured to apply product to a surface, each of the faces having a differing characteristic.

46. The applicator system of claim 44, wherein each of the application members has a differing compressibility.

47. The applicator system of claim 44, further comprising at least one additional holder, wherein each of the holders holds a product having a differing characteristic.

48. The applicator system of claim 47, wherein the differing characteristic is chosen from at least one of product type and product color.

49. The applicator system of claim 44, further comprising a case configured to hold the applicator assembly and the at least one additional application member.

50. An applicator system comprising:

the applicator system of claim 1; and at least one additional holder.

51. The applicator system of claim 50, further comprising least one additional application member, wherein each of the application members has at least one face configured to apply product to a surface, each of the faces having a differing characteristic.

52. The applicator system of claim 50, further comprising at least one additional application member, wherein each of the application members has a differing compressibility.

53. The applicator system of claim 50, wherein each of the holders holds a product having a differing characteristic.

54. The applicator system of claims 53, wherein the differing characteristic is chosen from at least one of product type and product color.

55. The applicator system of claim 50, further comprising a case configured to hold the applicator assembly and the at least one additional holder.

56. A method of applying a product to a surface, the method comprising:

providing the applicator assembly of claim 1, wherein a product is held in the holder and the holder is mounted with respect to the application member such that the chamber receives the product;

placing the at least one face of the application member in contact with the surface; and placing the product in contact with the surface.

57. The method of claim 56, wherein the placing of the at least one face in contact with the surface comprises compressing the application member.

58. The method of claim 57, wherein the compressing of the application member causes at least a portion of the product to one of protrude from the chamber opening and be substantially level with the chamber opening so as to enable the placing of the product in contact with the surface.

59. An applicator system, comprising:

a plurality of application members, each application member comprising at least one face configured to apply product to a surface, and each application member defining a chamber having an opening in the at least one face; and at least one holder configured to hold the product and to be removably mounted relative to each of the application members so as to permit each of the chambers to removably receive the product.

60. The applicator system of claim 59, wherein each of the at least one faces has a differing characteristic.

61. The applicator system of claim 59, wherein each of the application members has a differing compressibility.

62. The applicator system of claim 59, further comprising at least one additional holder.

63. The applicator system of claim 62, wherein each of the holders holds a product having a differing characteristic.

64. The applicator system of claim 63, wherein the differing characteristic is chosen from at least one of product type and product color.

65. The applicator system of claim 63, wherein each of the holders holds a make-up product.

66. The applicator system of claim 59, further comprising a case configured to hold the plurality of application members and the at least one holder.

67. An applicator system, comprising:

at least one application member comprising at least one face configured to apply product to a surface, the at least one application member defining a chamber having an opening in the at least one face; and a plurality of holders configured to hold the product and to be removably mounted relative to the at least one application member so as to permit the chamber to removably receive the product.

68. The applicator system of claim 67, further comprising at least one additional application member, wherein each of the at least one faces has a differing characteristic.

69. The applicator system of claim 67, further comprising at least one additional application member, wherein each of the application members has a differing compressibility.

70. The applicator system of claim 67, wherein each of the holders holds a product having a differing characteristic.

71. The applicator system of claim 70, wherein the differing characteristic is chosen from at least one of product type and product color.

72. The applicator system of claim 70, wherein each of the holders holds a make-up product.

73. The system of claim 67, further comprising a case configured to hold the at least one application member and the plurality of holders.

* * * * *

UNITED STATES PATENT AND TRADEMARK OFFICE

CERTIFICATE OF CORRECTION

PATENT NO. : 6,840,694 B2
DATED : January 11, 2005
INVENTOR(S) : Jean-Louis H. Gueret It is certified that error appears in the above-identified patent and that said Letters Patent is hereby corrected as shown below:

Column 12,
Line 47, “configure” should read -- configured --.

Column 15,
Lines 13-14, “comprising least” should read -- comprising at least --.
Line 23, “claims” should read -- claim --.

Signed and Sealed this

Seventeenth Day of May, 2005

JON W. DUDAS
*Director of the United States Patent and Trademark Office*